US008583513B1

(12) United States Patent
Talreja et al.

(10) Patent No.: US 8,583,513 B1
(45) Date of Patent: Nov. 12, 2013

(54) SYSTEMS AND METHODS FOR OFFER SELECTION

(75) Inventors: Kamlesh T. Talreja, Issaquah, WA (US); Timothy R. Kohn, Seattle, WA (US); Jonathan Joseph Bryak, Everett, WA (US)

(73) Assignee: Amazon Technologies, Inc., Reno, NV (US)

( * ) Notice: Subject to any disclaimer, the term of this patent is extended or adjusted under 35 U.S.C. 154(b) by 868 days.

(21) Appl. No.: 12/048,490

(22) Filed: Mar. 14, 2008

(51) Int. Cl.
*G06Q 30/00* (2012.01)

(52) U.S. Cl.
USPC ..... 705/27.1; 705/14.4; 705/26.1

(58) Field of Classification Search
USPC ..... 705/1, 26, 27, 26.1, 27.1, 14.4
See application file for complete search history.

(56) References Cited

U.S. PATENT DOCUMENTS

| | | | | |
|---|---|---|---|---|
| 7,698,171 | B2 | 4/2010 | Rampell et al. | |
| 2002/0055933 | A1 * | 5/2002 | Feathers et al. | 707/104.1 |
| 2006/0173773 | A1 * | 8/2006 | Ettinger | 705/37 |
| 2008/0077506 | A1 * | 3/2008 | Rampell et al. | 705/27 |
| 2008/0091528 | A1 | 4/2008 | Rampell et al. | |
| 2008/0162269 | A1 * | 7/2008 | Gilbert | 705/10 |
| 2008/0270209 | A1 * | 10/2008 | Mauseth et al. | 705/7 |
| 2009/0106100 | A1 * | 4/2009 | Mashinsky | 705/14 |
| 2009/0182677 | A1 * | 7/2009 | Otto et al. | 705/80 |
| 2009/0234710 | A1 * | 9/2009 | Belgaied Hassine et al. | 705/10 |
| 2009/0292599 | A1 * | 11/2009 | Rampell et al. | 705/14.13 |

FOREIGN PATENT DOCUMENTS

WO WO 2008/014226 A2 1/2008

OTHER PUBLICATIONS

"Affiliates-Integration: Join the Party," by Matthew Wall, New Media Age (Feb. 21, 2008), pp. 23-24.*
U.S. Appl. No. 60/820,701, filed Jul. 28, 2006, for Alex Rampell et al.
U.S. Appl. No. 60/825,885, filed Sep. 15, 2006, for Alex Rampell et al.
U.S. Appl. No. 60/868,767, filed Dec. 6, 2006, for Alex Rampell et al.
U.S. Appl. No. 60/869,899, filed Dec. 13, 2006, for Alex Rampell et al.
U.S. Appl. No. 60/914,298, filed Apr. 26, 2007, for Alex Rampell et al.

* cited by examiner

*Primary Examiner* — Jeffrey A Smith
*Assistant Examiner* — Anne Georgalas
(74) *Attorney, Agent, or Firm* — Kilpatrick Townsend and Stockton LLP

(57) ABSTRACT

A featured offer for an item in an electronic marketplace is selected based on factors such as estimated conversion rate and contribution profit. Qualified offers from various merchants are analyzed using a variety of filters, algorithms, and/or criteria to select an offer that meets the goal(s) of the marketplace provider, while providing customers with offers having terms that are also attractive to the customer. Secondary offers and/or advertisements also can be selected using similar approaches.

25 Claims, 7 Drawing Sheets

700

SYSTEMS AND METHODS FOR OFFER SELECTION

BACKGROUND

The present disclosure relates generally to the offering of items in an electronic environment, and in particular to selecting between various offers for an item to present to a customer in the electronic environment.

As an ever-increasing amount of purchasing decisions are made electronically, the competition among online retailers, merchants, and other such entities is increasing accordingly. The competition not only relates to attracting and retaining customers to a particular merchant or marketplace, which can be more challenging in an electronic environment that in a traditional brick-and-mortar environment, but there is also competition between retailers who wish to have their items included or featured on various Web sites or other electronic marketplaces where the same item might be offered by multiple entities.

Various online retailers and/or electronic marketplaces, for example, have sites where a retailer offers items for electronic purchase from that particular retailer. An electronic marketplace may offer items for consumption (e.g., sale, rental, lease, etc.) from various retailers. A retailer's offer is prominently featured on a page containing or displaying that item, as will be referred to herein as a "detail page," when a user searches for, or navigates to, a specific item. The detail page may have, for example, product information and reviews about the item. A marketplace may offer items from a retailer associated with the marketplace as well as by other retailers. For example, a merchant or retailer that operates an electronic marketplace might not always carry an item, or have the item in stock, such merchants, referred to herein as "first party merchants," also display offers from other merchants, herein referred to as "third party merchants," in less prominent areas of the detail page, or on another page to which a customer can be directed. The term merchant as used herein refers to any entity capable of offering an item for consumption in an electronic environment. A first party merchant also can have an arrangement where third party offers are displayed in less prominent areas even when the first party merchant currently offers the item for sale. While the retailer might lose out on the sale by showing these third party offers, the retailer may have, for example, an agreement with the respective third party merchant whereby the retailer gets a percentage of the sale price or other such fee for directing the customer to purchase the item from the other entity. However, among other potential complications, determining which offer from the various merchants is selected to be presented in a prominent portion of the user interface can be challenging.

Accordingly, it is desirable to improve the process for presenting such offers to a customer. It also can be desirable for the process to be beneficial to first and third party merchants, and to promote competition between the third party merchants to improve the overall offerings available.

BRIEF DESCRIPTION OF THE DRAWINGS

Various embodiments in accordance with the present disclosure will be described with reference to the drawings, in which.

DETAILED DESCRIPTION

Systems and methods in accordance with various embodiments of the present disclosure may overcome one or more of the aforementioned and other deficiencies experienced in conventional approaches to presenting offers for an item to display to a customer in response to a receiving a request for information about the item. As used herein, the term "item" can refer to anything that can be ordered, purchased, rented, used, or otherwise consumed and/or accessed via a network request or electronic submission, such as a product, service, or system. A request can include any appropriate request sent over an appropriate system or network, such as a request submitted to a Web page over the Internet or a message sent via a messaging system to a content provider, for example. The term "marketplace" will be used herein to generically refer to an electronic environment, such as a Web site or virtual sales network, for example, wherein items can be offered for sale and customers can agree to purchase those items.

Figure 1:
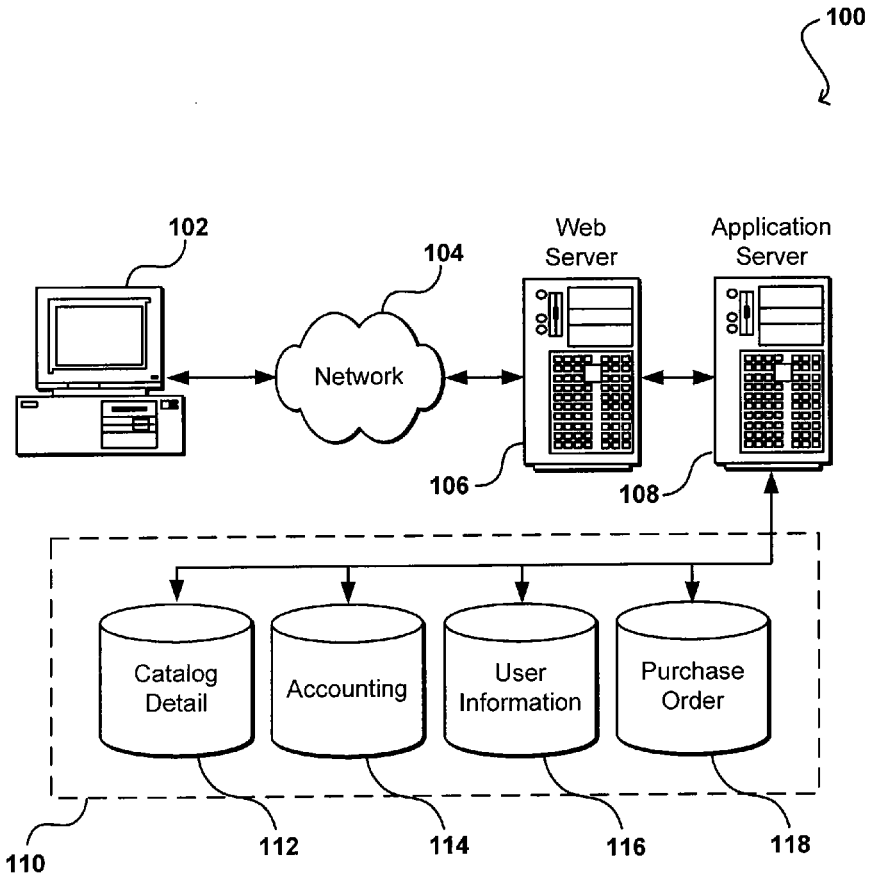
FIG. 1 illustrates a system configuration that can be used in accordance with one embodiment.

FIG. 1 illustrates an example of an environment 100 for implementing aspects in accordance with various embodiments. As will be appreciated, different environments may be used, as appropriate, to implement various embodiments. The environment 100 shown includes an electronic client device 102, which can include any appropriate device operable to send and receive requests, messages, or information over an appropriate network 104 and convey information back to a user of the device. Examples of such client devices include personal computers, cell phones, handheld messaging devices, laptop computers, set-top boxes, personal data assistants, electronic book readers, and the like. The network can include any appropriate network, including an intranet, the Internet, a cellular network, a local area network, or any other such network or combination thereof. Protocols and components for communicating via such a network are well known and will not be discussed herein in detail. Communication over the network can be enabled by wired or wireless connections, and combinations thereof. In this example, the network includes the Internet, as the environment includes a Web server 106 for receiving requests and serving content in response thereto, although for other networks an alternative device serving a similar purpose could be used as would be apparent to one of ordinary skill in the art.

The environment in one embodiment is a distributed computing environment utilizing several computer systems and components that are interconnected via communication links, using one or more computer networks or direct connections. However, it will be appreciated by those of ordinary skill in the art that the system could operate equally well in a system having fewer or a greater number of components than are illustrated in FIG. 1. Thus, the depiction of the system 100 in FIG. 1 should be taken as being illustrative in nature, and not limiting to the scope of the disclosure.

The illustrative environment further includes at least one application server 108 and a data store 110. As used herein the term "data store" refers to any device or combination of devices capable of storing, accessing, and retrieving data, which may include any combination and number of data servers, databases, data storage devices, and data storage media, in any standard, distributed, or clustered environment. The application server can include any appropriate hardware and software for integrating with the data store as needed to execute aspects of one or more applications for the client device, handling a majority of the data access and business logic for an application. The application server provides access control services in cooperation with the data store, and is able to generate content such as text, graphics, audio, and/or video to be transferred to the user, which may be served to the user by the Web server in the form of Hypertext Markup Language (HTML) for at least one Web page using hypertext transfer protocols. The handling of all requests and responses, as well as the delivery of content between the client device 102 and the application server 108, can be handled by the Web server.

Each server typically will include an operating system that provides executable program instructions for the general administration and operation of that server, and typically will include a computer-readable medium storing instructions that, when executed by a processor of the server, allow the server to perform its intended functions. Suitable implementations for the operating system and general functionality of the servers are known or commercially available, and are readily implemented by persons having ordinary skill in the art, particularly in light of the disclosure herein.

The data store 110 can include several separate data tables, databases, or other data storage mechanisms and media for storing data relating to a particular aspect. For example, the data store illustrated includes mechanisms for storing catalog detail data 112, accounting data 114, user information 116, and purchase order data 118. It should be understood that there can be many other aspects that may need to be stored in the data store, such as for page image information and access right information, which can be stored in any of the above listed mechanisms as appropriate or in additional mechanisms in the data store 110. The data store 110 is operable, through logic associated therewith, to receive instructions from the application server 108, and obtain, update, or otherwise process data in response thereto. In one example, a user might submit a search request for a certain type of item. In this case, the data store might access the user information to verify the identity of the user, and can access the catalog detail information to obtain information about items of that type. The information then can be returned to the user, such as in a results listing on a Web page that the user is able to view via a browser on the user device 102. Information for a particular item of interest can be viewed in a dedicated page or window of the browser.

In one particular embodiment, a system for implementing a marketplace manages a listing of offers submitted by a plurality of first and third party sellers to provide for consumption of one or more items to a buyer. In this example the marketplace system includes a retail server, an offer listing engine, a back end interface, and an offer listing management engine. The engines and interface can be implemented using separate computing systems (e.g., separate servers) or may be implemented as processes on a single computing system. Further, each engine or interface may alternatively be implemented using multiple, distributed systems. The retail server can be configured to provide a front-end interface to buyers and sellers desiring to perform transactions using the marketplace, such as by using a plurality of Web-based interfaces configured to allow buyers and sellers to set up and manage accounts, offer items for sale, provide information related to the items for sale, browse items being offered for sale, purchase items being offered for sale, etc. The retail server also can be configured to implement supportive functionality related to these transactions such as security functions, financial transaction functions, user identification functions, etc. The retail server may further be configured to provide an offer listing Web site, which can include a plurality of Web pages displaying items that have been offered for sale by third party sellers.

The offer listing engine in this example is a computing system configured to receive, store, and provide a listing of offers to sell items that have been submitted by a first or third party seller. Each offer within the listing may include a wide variety of information related to the item and the sale of the item such as an item description, an item price, an item condition, shipping information, seller information, etc. The offer listing engine may further be configured to implement one or more functions related to the offer listing, such as a search function callable by the retail server based on input received through a user interface implemented by the retail server. For example, a buyer may retrieve a search interface from the retail server and provide a search term in an input field of the user interface, such as "laptop computer." The retail server may be configured to communicate this search term to the offer listing engine, which is able to implement a search function to search through the offer listing database to generate an offer listing containing all of the items in the offer database that correlate to the submitted search term. Accordingly, the offer listing engine may be configured to generate a complete listing of offers for laptop computers that are currently being offered for sale by third party sellers in the marketplace system.

Figure 2:
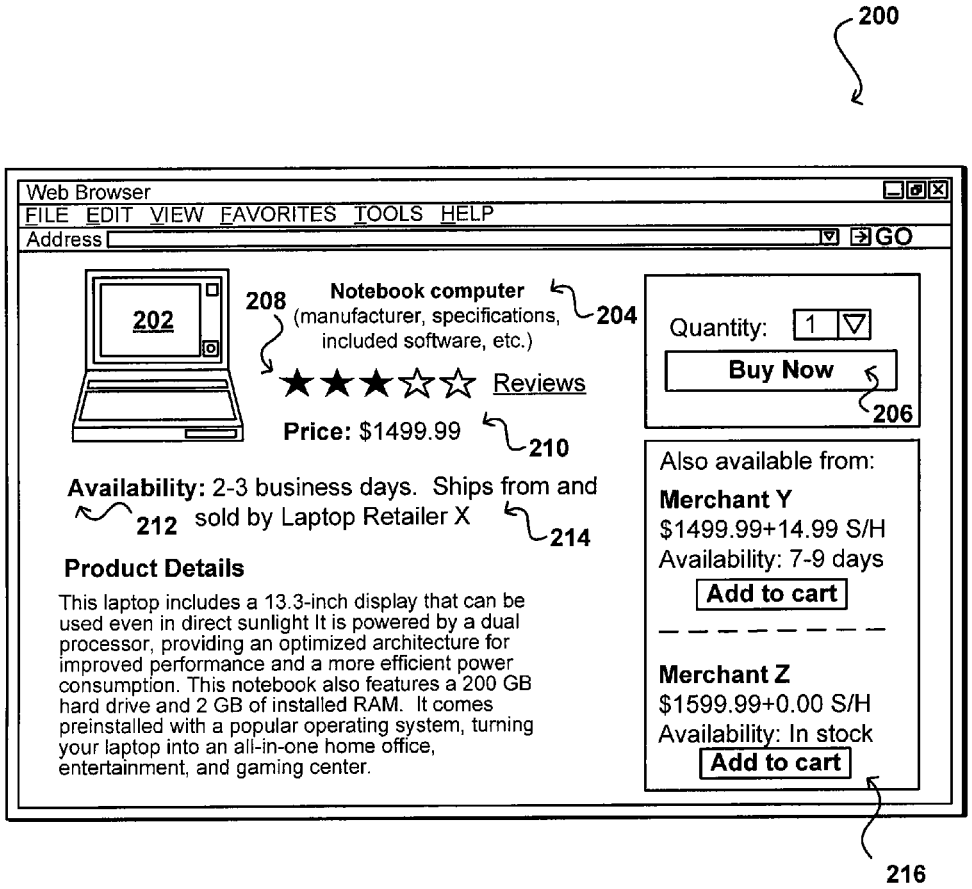
FIG. 2 illustrates an example of a user interface that can be used in accordance with one embodiment.

FIG. 2 illustrates a graphical user interface window 200 for a browser application on a client device in accordance with one embodiment, here displaying a Web page in which a user is able to view information relating to an item of interest, in this case a particular laptop computer. In this example, the item is being viewed in a page provided by a first party merchant (e.g., an electronic retailer, wholesaler, or other such provider as discussed above), where is displayed an image 202 of that type of laptop, item information 204 about that type of laptop, and a user-selectable purchase element 206 allowing the user to purchase the laptop (or at least place the laptop into a virtual shopping cart or shopping bag as known in the art for subsequent purchase). While the term "purchase" will be used for purposes of explanation, it should be understood that other methods of consumption (e.g., rent or lease) can be used as well as discussed elsewhere herein. Mechanisms for searching and displaying inventory from a catalog detail or other such data store, managing item information, running an electronic store or outlet, providing for user purchasing, and other related functionality are well known in the art and will not be discussed herein in detail.

Also shown in the illustrative user interface of FIG. 2 is user rating information 208 for the item, along with pricing information 210 for the offer displayed. The availability information 212 for the item at that price is displayed, along with an indication of the merchant 214 offering the item for sale at those terms. The image 202 of the item, along with the price 210, availability 212, and offering entity 214 information constitutes the "featured offer" for this item, as the offer is displayed prominently in the detail page for the item. The user-selectable purchase element 206 corresponds to the featured offer, such that selection of the purchase element by a customer causes the featured offer to be "accepted" (pending any additional steps in the purchasing process, which can vary as known in the art) and the purchase made under the terms of the featured offer. Methods for notifying a merchant, sending a confirmation to the customer, obtaining payment information, fulfilling an order, and performing other aspects of an e-commerce or other such electronic transaction are well known in the art and will not be discussed herein in detail. Data for the sale or transaction can comprise input information, such as the number of items to be purchases, as well as stored, cached, or extracted information from resources such as the catalog detail, user information, and purchase order data stores illustrated in FIG. 1.

While the featured offer might be selected for a specific reason, such as the site being offered by Laptop Retailer X, typically the first party merchant, a customer might prefer a different offer. For example, the featured offer might not offer the lowest price, which might be the primary consideration for a customer. In another example, a customer might need the item to ship right away and might not care about spending a little extra to get the item more quickly. In order to address these needs, and to prevent the customer from buying elsewhere and losing out on any revenue for the transaction, the detail page also shows secondary offers 216 for the item from other sources, namely third party merchants or even offers from the first party merchants with different terms (i.e., an item at a higher price but faster availability). As can be seen, one of the secondary offers has a higher price, but is available to ship immediately since the item is in stock at that particular merchant. A customer then is able to select the in-stock item for purchase using the secondary offer of Merchant Z. While the first party merchant may not end up selling the item directly to the customer, the first party merchant may have an arrangement in which the first party merchant receives some compensation from Merchant Z as a result of the transaction being initiated and/or completed through the marketplace of the first party merchant. This compensation results in some contribution profit for the first party merchant. As used herein, contribution profit refers to a predicted or determined profitability obtained by a first party merchant offering a site or marketplace, for example, as a result of a transaction, even if the transaction involves a customer transacting with a third party merchant. If a customer purchases an item from a third party merchant through a marketplace, that third party will thus owe a commission or other such fee to the first party merchant. This commission can be a fixed fee or percentage of the price of the item, for example, or any other appropriate amount. The contribution profit then is the difference between the commission and the operating or other expenses allocated to facilitating the transaction.

Many third party merchants would be willing to pay a higher commission if their offers were displayed prominently in the detail pages as the featured offers. If the entity operating the marketplace is a first party merchant who offers the items, then the first party seller might not want to give the featured offer to a third party, which would decrease sales for the first party merchant. A first approach would be to always allocate the featured offer to the first party merchant when the first party merchant offers the item, and allow a third party merchant to provide the featured offer when the first party merchant does not offer the item. The third party merchant could then pay a higher commission when the third party offer is featured as the featured offer. In some cases, the third party merchant offering the item can simply be rotated among other third party merchants offering the item when there is not a first party offer in order to provide relatively equal feature time to each merchant. In other embodiments, a marketplace might be a service provided by an entity that does not actually offer items for sale, in which case third party merchants would only be competing with each other to provide the featured offer using approaches described herein.

In another approach, the first party merchant's offer could be featured as the featured offer whenever the first party merchant has the item in stock, or when the first party merchant has the lowest price. At other times, a third party offer could be shown when that third party merchant has the item in stock or offers the item at a lower price. This approach is not necessarily optimal for the first party merchant in all situations, as the first party seller is competing on an even playing field with the other merchants and might lose out to third party merchants who routinely offer their items at as little as a penny less than the first party merchant. Further, as a number of sales go to third party merchants, the first party merchant's control over the user experience (including shipping, customer service, returns, etc.) will diminish accordingly. Further, as discussed above, customers might prefer to buy from the first party merchant due to issues such as familiarity or trust, which could be lessened due to the customers increasingly being involved with third party merchants. Also, users in general might prefer different offers for a number of reasons, such as a combination of price, availability, and merchant reputation or familiarity.

In order to address these concerns, an algorithm or determination approach can be used that compares offers from various merchants and determines the offer that is likely to be preferred by a majority of customers viewing an item. For example, when a customer navigates to a detail page containing an offer for an item, a selection application or algorithm can determine whether there are multiple offers for the item. If so, the algorithm determines which offer has the lowest price. However, in order to give the first party merchant an advantage since they are providing the site, a price preference can be given to any offer by the first party merchant. For example, if there are three offers for the same price, the first party offer would be displayed as the featured offer. A threshold percentage can be set for situations where a third party offer has a lower price than the first party offer. The threshold percentage can be any appropriate percentage, such as 5-10%, but should not be so large as to disproportionately favor the first party offers. The threshold does not need to be a percentage, but can be a set dollar amount, dollar amount based on pricing ranges, or any other appropriate amount. In a case where the threshold is set to 8%, an offer from a third party merchant must be at least 8% lower than the first party offer price in order to be selected as the featured offer. If the third party offer is not at least 8% lower than the first party merchant's price, then the first party offer will be selected to be rendered for display as the featured offer. The algorithm also can consider total cost, which can include shipping, handling, tax, and/or any other information that can ultimately affect the final cost to the customer. After selection, the detail page for the item can be rendered and provided for display to the customer. It should be noted that although reference is made to a detail page in various examples, this is merely an example for explanation and that a featured offer could be displayed in any appropriate page, window, display, interface, or other electronic display.

Although such a pricing-based approach can be desirable, it may not be desirable for customers to always be presented with the lowest price, particularly when the item is not in stock or will not be available within a reasonable amount of time. Accordingly, an offer selection algorithm or other such approach can be sued to determine an availability for each offer before selecting an offer to display as the featured offer.

For example, an algorithm might only consider items that are in stock. Because such an approach would not work in all situations, such as for pre-orders or for the purchase of services or customized items, an algorithm can instead set another threshold, here an availability threshold. For example, the algorithm might determine which offer has the earliest availability. Then, the algorithm might reject any offer that does not include an availability within a threshold amount or period of the earliest determined availability. For a threshold set to 96 hours, for example, if one of the offers has the item in stock then only offers with availability within the following 96 hours will be considered. For a threshold of 3 days, a first availability of February 1 might exclude any offer with an availability later than February 4. Business days, percentages, or any other such approach can be used as well. The availability can be used as a first pass to eliminate offers with poor availability before the pricing determination, or can be done after offers are eliminated based on the pricing threshold, or the two thresholds can be used in combination to provide acceptable offers.

While such an approach would result in a featured offer with what should be a good combination of price and availability, the approach does not take other factors into account. For example, a customer might be happy to purchase an item from a well known third party merchant, but might not be willing to purchase an item from an unknown third party merchant. Further, a customer might not be willing to purchase from a third party merchant that has a bad reputation, poor feedback, a lower user rating, or any of a number of other approaches used to determine the quality of service that can be expected from a merchant. Accordingly, an offer selection algorithm can take into account a rating or status of a merchant for an offer. For example, each third party merchant can, in a simple example, be rated as either "qualified" to provide a featured offer or "not qualified" to provide a featured offer, such as by using a performance-based qualification approach. The determination can be made by any appropriate entity using any appropriate criteria, such as a group of the first party merchant dedicated to researching aspects of each third party merchant, including sales volume, return volume, amount of transactions completed, a minimum number of customer feedback received, a minimum feedback rating, customer complaint volume and type, etc. Any third party merchant that is rated as "not qualified" thus can be excluded in a first pass (or subsequent pass) of the algorithm, and will not have any offers featured. Other such merchant approval indicators can be used as well.

In more complex approaches, each third party merchant can be assigned a merchant rating, which can be determined and updated as necessary. For example, a merchant might get a rating based on sales volume, conversion percentage, return percentage, complaint percentage, positive customer feedback, and/or other such factors, which can be combined to give the merchant an overall rating. The ratings then can be used to exclude merchants with a rating below a certain threshold. The ratings also can be used with the pricing and/or availability information to rank the available offers for an item and select the offer to feature. For example, if three offers are all within the pricing and availability thresholds, then the merchant with the highest ranking might get their offer featured. In another approach, only offers from merchants with a minimum rating are considered, which then can be excluded based on availability, and finally the lowest priced offer (taking into account any pricing advantage to the first party merchant) will be selected as the featured offer.

While such approaches attempt to provide customers with the "best" offer for any item at the time of the request, it can be difficult to determine whether various goals and success metrics are being achieved, as well as to even determine precisely what the goals and metrics should be. Goals become somewhat more arbitrary as the advantages are increased for the first party merchant. For example, if customers are happy with the first party merchant site and are equally happy with the qualified third party merchants, there may not be an advantage to directing those customers to the first party merchant. It may not be beneficial to feature a first party merchant offer even when one of the third party merchant offers would result in more net profit for a particular transaction. Further, if customers are more likely to buy a particular type of item from a third party merchant, it may not make sense to feature the first party offer and risk losing contribution from the sale. While the pricing advantage given to the first party merchant accounts for factors such as an assumed higher conversion or click-through rate, for example, it would be desirable to implement an algorithm or approach that more accurately and objectively determines which items to feature based upon an actual predicted profitability of the offer, among other such factors. Such an approach can still provide users with attractive offers, while generating additional revenue for the first party merchant and generating more sales for the third party merchants, thus also improving profits for the third party merchants. Approaches also can analyze and consider additional inputs and information as discussed in other portions of this disclosure.

Systems and methods in accordance with various embodiments can utilize algorithms and similar analytical tools to take into account not only factors such as price, availability, and merchant ratings or qualifications, but also (or alternatively) take into account factors such as revenue, contribution profit, conversion rates, and predicted profitability. A goal for such a process can be to optimize contribution profit (CP) while at least maintaining conversion levels and customer experience. In order to attain such a goal, an analytical model can be utilized that includes as inputs a contribution profit for each offer listing, as well as an approximation of the conversion rate for a merchant, such as a conversion rate across all items that the merchant sells, a subset of items sold by that merchant, items in a particular category, etc. In one embodiment, these criteria alone are used to select an offer to feature. In other embodiments these criteria are used with other criteria, such as in the case of multiple offers meeting pricing and availability criteria as discussed above. Since price and availability are tightly coupled to conversion and customer experience, these criteria can be advantageous in at least some situations to use as inputs to an offer selection algorithm or similar analytical tool. There are, however, other harder-to-quantify conversion drivers such as merchant brand recognition and category specialization that can be captured in merchant-level conversion metrics. By considering the merchant-level conversion in conjunction with offer-level contribution profit, an offer selection algorithm can optimize for both contribution profit and customer experience. Various combinations will be discussed herein, but it should be understood that other combinations and orders of applying the combinations can be used within the scope of the various embodiments.

Figure 3:
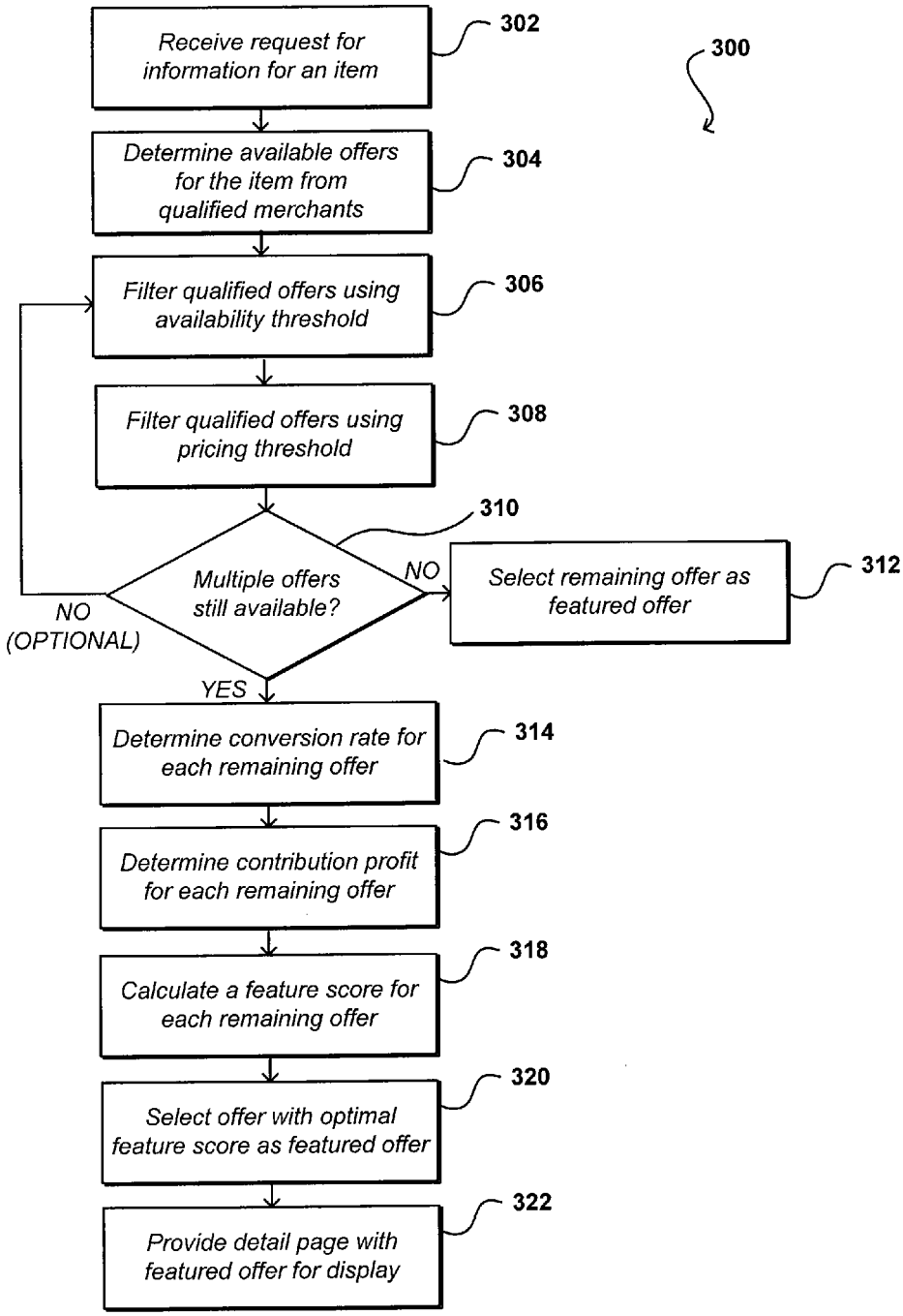
FIG. 3 illustrates steps of a process for selecting a featured offer that can be used in accordance with one embodiment.

FIG. 3 illustrates one such process 300 for selecting an offer to feature that can be used in accordance with one embodiment. In this process, a request to receive information for an item is received from a customer 302. In one embodiment, this takes the form of a user of a Web browser requesting a page including information about an item from a first party merchant Web site. Upon receiving the request, an application running on an application server, for example, queries an appropriate data store to determine which merchants offer that item, as well as the terms for each offer. Either as part of the query or as a step after an initial merchant query, an eligibility filter is applied 304. The eligibility filter, when used as part of the query, only returns offer results for merchants having a "qualified" or other such eligibility value stored in the data store for at least this type of offer. When used as a filter, the algorithm can examine all offers for the item and as a first pass can exclude from consideration any offer for a merchant having a "not qualified" or similar value stored that indicates the merchant is not eligible to have their offer featured for this item. In many instances a qualification status will be a Boolean value, where a merchant is either qualified or not qualified. In other instances, as discussed above, a merchant can have a rating and the algorithm can exclude any merchant having a rating below a qualification threshold for the item, category, etc.

After the offers from qualified merchants are obtained, an availability filter can be applied that excludes offers based on the indicated availability from each merchant 306. Use of such a filter assumes correct, near real-time information being provided by or for the third party merchants with respect to current levels of stock and availability. As discussed above, any qualified offer listings that exceed a defined threshold amount of time from the first availability can be excluded from consideration. By utilizing the best availability instead of a maximum availability, the algorithm can take into account situations such as pre-orders and custom orders that might not be available to ship for some significant amount of time.

As discussed above, any qualified offers that fall within the availability requirements also can be filtered by price 308. In this example, the lowest price offer is determined. A pricing threshold is applied to the lowest price, such as is discussed above, and any offer having a price that is not within the threshold amount of the lowest price is excluded from consideration for a featured offer. It should be noted that the pricing filter also could be applied before or in combination with the availability filter. Multiple filters also can be used, such as a first pricing filter for just the price of the item and a second pricing filter including tax, shipping, etc.

At this point, the algorithm has located offers for the requested item that are available from qualified merchants, and that meet the pricing and availability threshold. A determination is made as to whether there are multiple offers still remaining 310. If there is more than one offer still eligible, then a second pass can optionally be made through the pricing and/or availability filters using a tighter threshold to further limit the number of available offers. If merchants are given variable qualification or similar ratings rather than Boolean qualification ratings, then a higher threshold can also be applied to the merchants for the remaining offers in order to further limit the available offers.

If there is only one remaining offer after applying the pricing, availability, and qualification filters for a selected number of times, then that offer is selected to be the featured offer to be provided for display to the customer in response to the request 312. If, however, there are still multiple eligible offers, such that each remaining offer is relatively comparable from a customer viewpoint based on pricing and availability, the algorithm can analyze the remaining offers in order to optimize for contribution profit, conversion rate, or any other appropriate factor for maximizing net revenue for the first party merchant.

When there are multiple offers still eligible to be featured, the remaining list of candidate offers will be denoted herein by the following:

$$\text{offerlistings}\{\text{Offer}[1], \ldots, \text{Offer}[n]\},$$

where offerlistings is the set of remaining offers, and n is the number of remaining offers.

In this example, for each remaining offer Offer[i], an estimated "click-through" rate is determined 314. The estimated click-through rate (CTR), or estimated conversion rate, represents the likelihood of the presentation of the offer for a given merchant resulting in an actual purchase of the offered item (and potentially any related items), or the "conversion" of an offer to a sale, purchase, or other such transaction outcome. While the term "click-through rate" will be used herein for purposes of explanation, various other conversation probabilities and determinations can be used within the scope of the various embodiments, and there should be no inference from the use of the term "click" that the embodiments are somehow limited to an embodiment such as a Web site where a user selects options by clicking a mouse button or other such action.

In order to estimate CTR in one embodiment, a randomized model is applied to parameters such as the number of times a third party merchant is selected for a featured offer (e.g., the number of impressions) along with purchase data for the merchant, including the number of times in which these featured offers (or "impressions") actually resulted in orders for that merchant. The difference, ratio, or percentage between the number of impressions and the actual number of orders is a simple way to estimate a click through rate in accordance with one embodiment. In order to improve the CTR estimation, the number of impressions (which can include instances other than just featured offers) versus the number of resulting orders can be examined at a category or sub-category level, or even at the item level if there is enough data. For example, a third party merchant might have an overall CTR that is at 75%, but for a certain type of item that the merchant is not known for, the CTR might be at 5%, as customers typically buy that type of item from another merchant. In cases where there is enough data, the choice of which offer to feature can be improved substantially by focusing more closely on the particular item, category, etc. If there is not a significant amount of data, the overall CTR might instead be a better indicator.

A goal of using an estimated CTR, instead of just computing a simple percentage, for example, is to introduce a degree of randomization so that even lower-converting merchants are given some exposure and an opportunity to improve their conversion rates. In one embodiment the CTR for a given offer, denoted herein as CTR[i], is determined using a parametric probability distribution P[Offer[i]]. Various other distribution functions, functions, algorithms, and/or calculations can be used as well as would be apparent to one of ordinary skill in the art in light of the teachings and suggestions contained herein. In some embodiments, a click boost can be applied prior to the computation for "immature" merchants. For example, merchants whose impressions are not statistically significant, or which are less than a predefined threshold, can be considered to be immature merchants. Click counts for immature merchants can be computed as an average of all mature merchants' click counts in one embodiment, helping to provide exposure to offers from new third party merchants.

In addition to calculating a CTR value for each offer, a contribution profit (CP) for each remaining offer Offer[i] can be determined 316. In this example, the maximum contribution profit for an offer is designated as Offer[i]·maxCP. As discussed above, the CP for an offer is generally the predicted profitability of an item being offered for sale, based upon the difference between the commission for the item if a sale results, and the operating expenses apportioned to the transaction. This calculation can take many factors into account, such as the sale price, shipping costs, etc. There are many ways to calculate commission and operating expenses in the art, which will not be discussed herein in detail but would be apparent to utilize to one of ordinary skill in the art in light of the teachings and suggestions contained herein.

While some embodiments can utilize only the CP or CTR values when selecting an offer to feature, it can be desirable to utilize both when making the determination. For example, an offer that will maximize profit is of little value if the merchant offering the item has a very low conversion rate, or is a merchant from which the customer is unlikely to purchase the item. On the other hand, it is not always desirable to feature the merchant most likely to sell the item if the resulting profit is not very good.

Accordingly, an algorithm in accordance with one embodiment calculates a feature score Score[i] for each remaining offer Offer[i] using the CTR and CP values 318. In one embodiment, the featured score for each offer is determined by multiplying the contribution profit by the estimated CTR, such as may be given by:

$$\text{Score}[i]=\text{CTR}[i]*\text{Offer}[i]\cdot\text{maxCP}$$

This equation can be considered to adjust the profit for each offer by the estimated percent chance that the customer will actually buy the item. So, in a generic example, a first offer with $5 contribution profit and an 80% estimated chance of selling will have a featured score of 4.0, while a second offer with a $6 contribution profit but only a 50% chance of selling will have a feature score of 3.0. Thus, the first offer will be featured even though the second offer would result in more profit if actually sold, as the calculation takes into account the actual likelihood of selling to estimate the worth of featuring each offer.

While this approach is sufficient in some situations, it also might be desirable to alter how much each of the CTR and CP values affect the ranking. For example, since CTR is an only an estimate of purchase likelihood which CP can be fairly accurately determined, it may be desirable to weigh CTR less when calculating the feature score for each remaining offer. A featured score for each offer then can be calculated in one embodiment according to the following:

$$\text{Score}[i]=\text{CTR}[i]^{ctr_weight}*\text{Offer}[i]\cdot\text{maxCP}$$

Here, ctr_weight is a weighting factor that can be applied to the CTR value to adjust how much of an effect CTR has on the overall feature score for an offer. Methods for weighting a term in an equation are well known in the art and will not be discussed herein in detail. It also should be understood that a similar result can be accomplished by applying a weighting factor to the contribution profit term, or to both terms if desired.

Once the feature score is calculated for all remaining offers, the offer with the optimal feature score is selected as the featured offer to be displayed to the customer 320. In many cases the optimal feature score will be the highest feature score of the remaining offers, but in other cases an optimal feature score might be the lowest score or a score closest to a particular value, for example. The detail page then can be generated or otherwise provided for display to the customer, the detail page including the featured offer 322. In one example, html code is generated for the page, including the featured offer, and the code is sent to the user to be rendered and displayed in a browser or other such application to the customer. In cases where secondary offers are presented to the user in another portion of the interface, such as is described above, the remaining offers can be displayed to the user as secondary offers. The secondary offers can be ordered by feature score, or by any other appropriate ranking or order such as by name, price, or availability.

Figure 4:
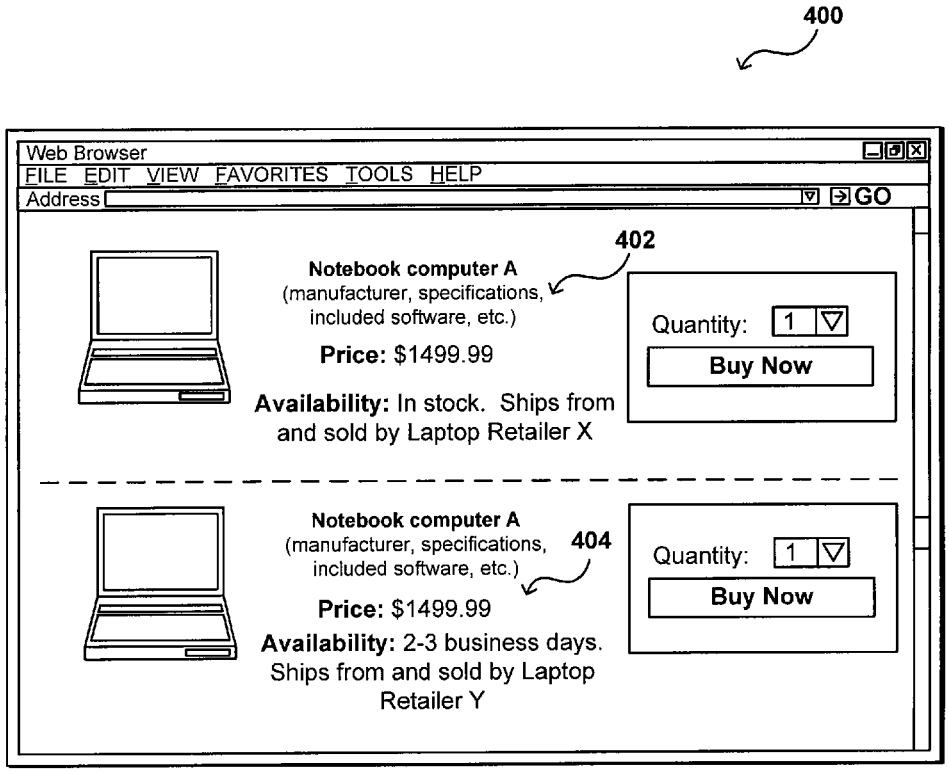
FIG. 4 illustrates an example of a user interface that can be used in accordance with one embodiment.

In some embodiments, the first party merchant might receive the featured offer whenever the first party merchant offers the item, and the third party merchants will receive the feature offer using a selection process as discussed herein only when the first party merchant does not offer the item. In other embodiments, the offer with an optimal feature score is selected regardless of which merchant offers the item. In still other embodiments, multiple feature offers can be shown, such as is illustrated in the example interface 400 of FIG. 4. The display in FIG. 4 shows two featured offers 402, 404 for the same item, each offer being from a different merchant. In one example, the first party merchant offer will always be displayed as the first featured offer 402, and a selected third party offer will appear as an alternative featured offer 404. In other embodiments, the two offers with the best feature scores will be displayed regardless of whether the first party merchant offer is featured, and in still other embodiments the first party offer will always be featured, but many not be the primary feature offer is a third party offer has a better feature score. In another embodiment, a number of the offers or all available offers can be displayed, with the offers being ordered or sorted based on the relevant feature score, with the offer with the next-best feature score being displayed after or secondary to the featured offer with the optimal feature score, etc. In a case where multiple offers are listed, approaches in accordance with one embodiment will always list the first party merchant offer at the top, or first location, while in others the first party merchant offer can be treated the same as any third party merchant offer.

It should be understood that the steps disclosed in the above example can be performed in many different orders, and that an order in the flowchart only applies to one embodiment but may differ in other embodiments. Further, not all steps in the above-described method are required, and there also can be other filters or approaches included, such that inclusion or exclusion from the above example should not be interpreted as limiting the variations and embodiments suggested herein.

Figure 5:
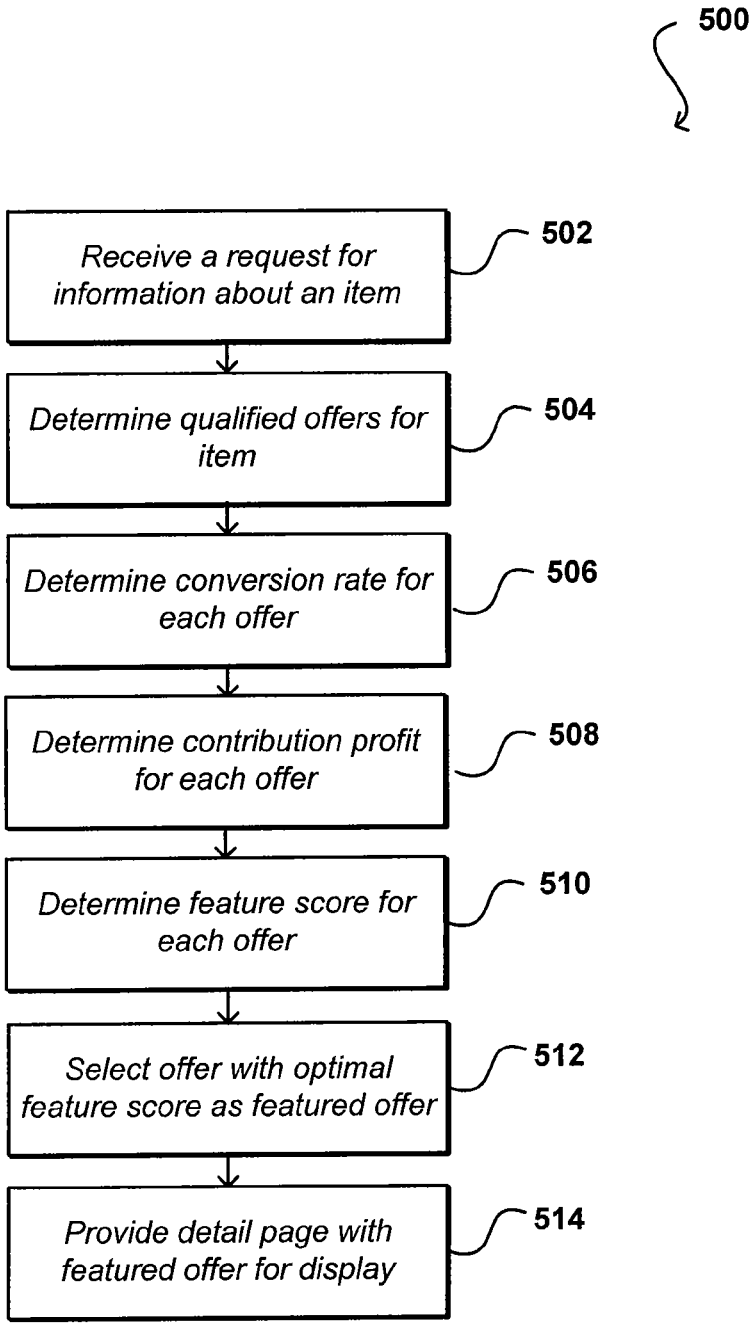
FIG. 5 illustrates steps of a process for selecting a featured offer that can be used in accordance with one embodiment.

In some cases, a first party merchant might choose to select feature offers in order to optimize profit, while hiding from the customer or at least not taking into account differences such as price and availability. FIG. 5 illustrates such an approach 500 that can be used in accordance with one embodiment. In this example, a request to receive information for an item is received from a customer 502. As discussed above, the request can be any appropriate request, such as an HTML request from a Web browser requesting a page including information about an item from a first party merchant Web site. Upon receiving the request, a determination is made as to which merchants offer that item, as well as the terms for each such offer 504. For each offer, an estimated click-through rate (CTR) is determined 506 as discussed herein. A contribution profit (CP) is also calculated for each remaining offer 508. An appropriate algorithm as discussed herein is used to calculate a feature score for each offer based on the CTR and CP values for that offer 510. As discussed above, the CTR or CP can be weighted to maximize contribution profit, adjusted to improve the likelihood of a sale, or a combination thereof. Once the feature score is calculated for all eligible offers, the offer with an optimal feature score is selected as the featured offer to be displayed to the customer 512. The detail page or other such interface, including the featured offer, is then provided for display to the customer 514. In order to further maximize profit, the approach also can utilize and approach such as is described above to ensure that the merchant for an offer is a "qualified" merchant, or has a similar such rating, so that a customer is further likely to purchase and not return the item. Other filters can be used as discussed and suggested elsewhere herein.

Figure 6:
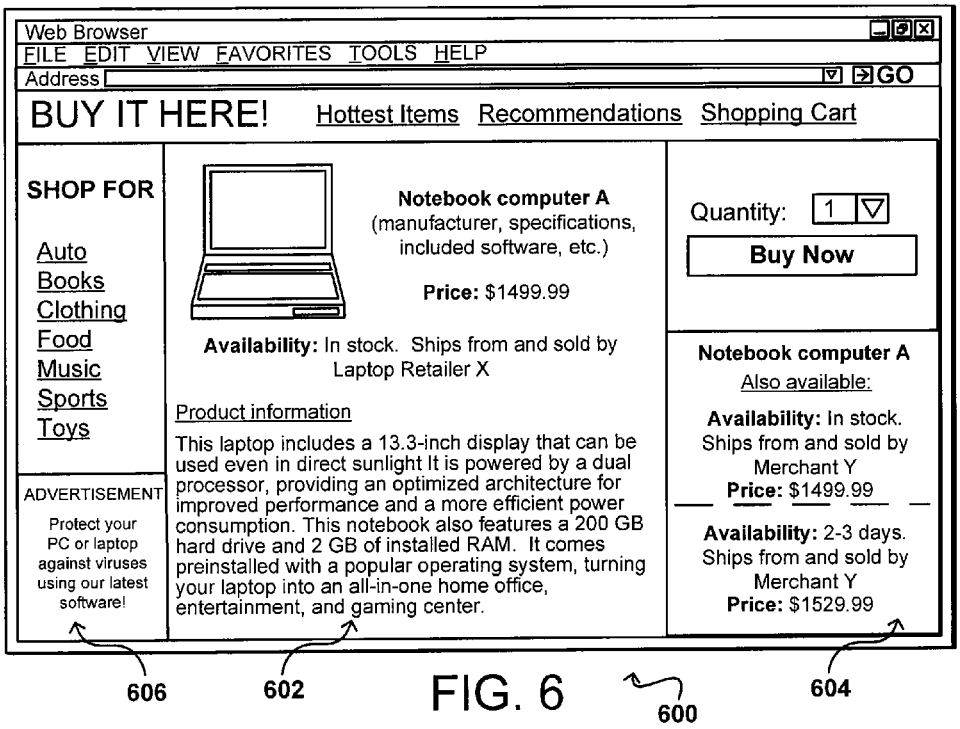
FIG. 6 illustrates an example of a user interface that can be used in accordance with one embodiment.

In cases where a first party merchant or marketplace operator wishes to further focus on maximizing profit, embodiments can take advantage of other delivery channels for generating revenue. One of these channels can include the selling of advertisement ("ad") space on a detail page, such as may relate to a category, sub-category, user classification, specific item, manufacturer, or any other appropriate information. For example, a first party merchant might have the ability to show an advertisement for a third party merchant on a detail page whenever an offer for that merchant is selected as the featured offer, which can be factored in with the overall contribution profit for that third party merchant offer. The example display 600 of FIG. 6 illustrates a detail page which includes a featured offer 602 and secondary offers 604. Also shown is an advertisement 606 relating in some way to the item being offered. If a merchant such as Laptop Retailer X also offers advertisements on the site which can be displayed with a selected featured offer 602, then the revenue from that advertisement 606 can be factored into the contribution profit for that particular offer. In many cases, the total amount of revenue for the instance of the advertisement can be added to the contribution profit from selling the item.

Figure 7:
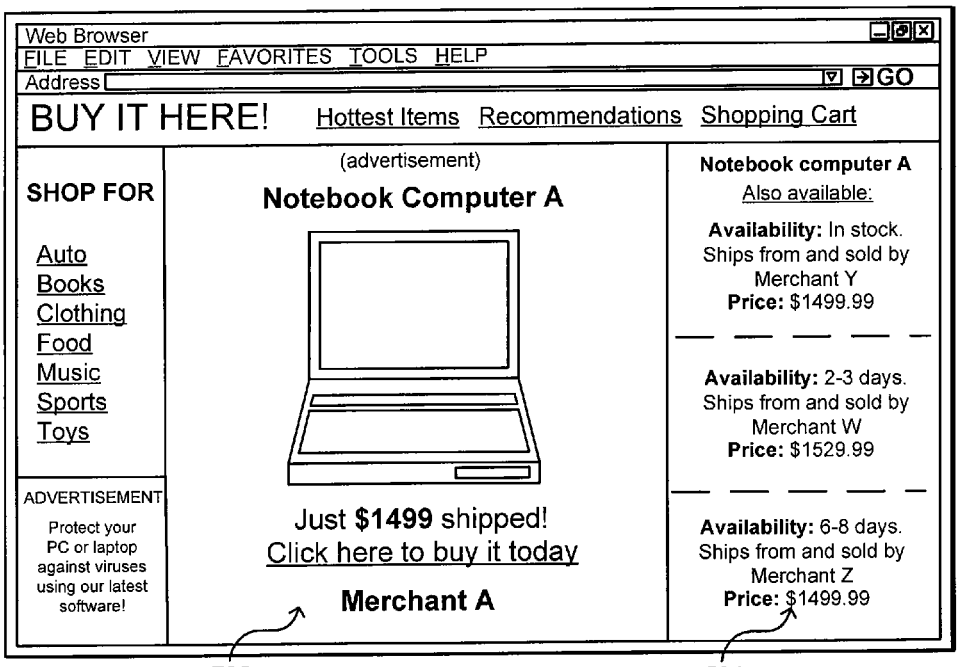
FIG. 7 illustrates an example of a user interface that can be used in accordance with one embodiment.

An approach in accordance with another embodiment is able to actually select an advertisement or similar element in place of a featured offer, such as where the first party merchant does not offer the item for sale or where a higher profit would be obtained by showing the advertisement if a customer clicks on the advertisement. FIG. 7 illustrates an example 700 wherein an advertisement 702 is displayed in the space of a detail page that would normally be reserved for a featured offer. As can be seen, there is no true "featured offer" on this page, but instead an advertisement is prominently featured. In other embodiments, the featured offer area can include a link to the advertiser's detail page or another site or marketplace offering the item. The example page does, however, show multiple secondary offers 704, in case the customer does not wish to click on the ad but would rather buy through the site using one of the secondary offers.

Figure 8:
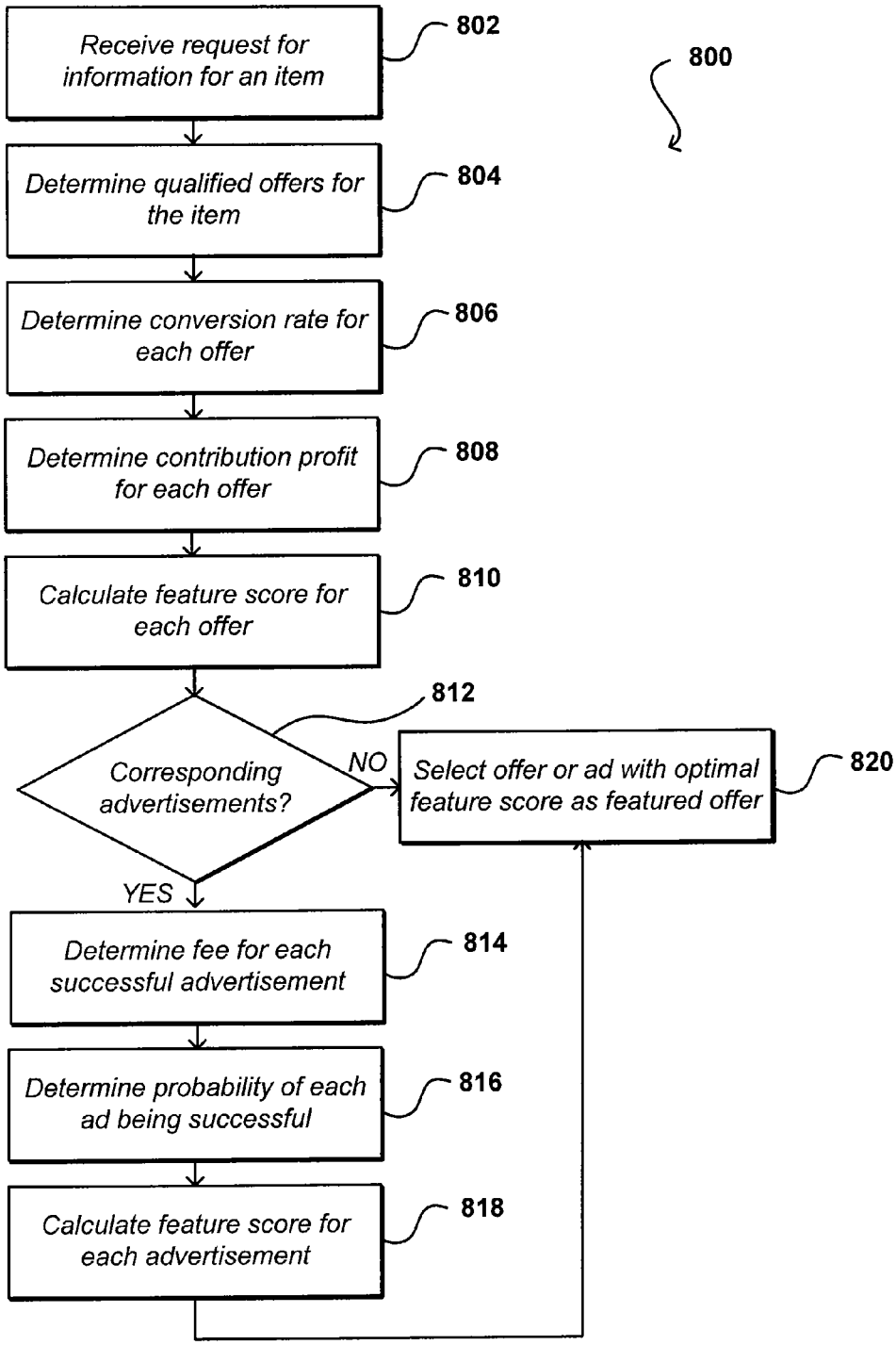
FIG. 8 illustrates steps of a process for selecting a featured offer that can be used in accordance with one embodiment.

FIG. 8 illustrates steps of an example method 800 that can be used to select an offer or advertisement to feature on a detail page in accordance with one embodiment. In this example, a request to receive information for an item is received from a customer 802 as discussed elsewhere herein. Upon receiving the request, an appropriate data store is queried to determine which merchants (qualified or otherwise) offer that item, as well as the terms for that offer 804. For each offer, an estimated click-through rate (CTR) is determined 806 as well as a contribution profit (CP) 808. A feature score is calculated for each offer based on the CTR and CP values for each offer 810. In this method, a determination is also made (before, after, or concurrently) as to whether there are any advertisements that can be shown for that item 812, which normally will relate specifically to that item, but also could link to a merchant selling items in that category, sub-category, etc. For customer satisfaction reasons, however, it can be advantageous in some situations to only substitute an ad for an offer when the ad itself gives the customer a chance to buy the same item, unless there are no offers for the item. For each applicable advertisement, a calculation is made to determine the relative "feature score" for that advertisement. In some embodiments, this involves determining the fee that will be paid if a user clicks or selects the ad and/or purchases the item as a result of clicking the ad 814. In some embodiments, a probability also can be determined for the likelihood that a user will click on the ad if displayed in the feature section 816. As with CTR, for example, this algorithm can be based on contextual or historical data, such as how often users typically click on that ad if displayed in the feature section. Other algorithms can take into account the history of the individual customer, such as whether or not the customer ever clicks on such an ad, and if so how often. Where there are multiple such ads, the fees and probabilities can be weighted as discussed above. Using the fee, probability, and/or any other such information, a feature score is calculated for the advertisement 818. Once the feature score is calculated for all eligible offers and applicable advertisements, the offer or ad with an optimal feature score is selected to be displayed in the feature offer location on the detail page 820. The detail page, including the featured offer or ad, is then provided for display to the customer. As with various other embodiments discussed above, other filters can be used with the ad approach as well, and results can be weighted to maximize profit, etc.

Any other methods or channels for generating revenue that are related to an item or offer also can be considered when determining contribution profit. For example, a user might be presented with the opportunity to receive offers or announcements from a third party merchant, such as via an email list, which can come with some financial compensation for the first party site. Or, when a customer purchases an item from a third party merchant, the customer can be presented with a coupon or discount offer for other items from that third party merchant, which can result in financial compensation to the first party site. Many other such ways and channels for generating revenue and transmitting content can be used as well using approaches discussed herein.

In order to improve the customer experience, and potentially also improve compensation profit, various other factors can be considered in an algorithm or approach to selecting an offer to feature. For example, when an offer relates to an item that a customer must pick up, or relates to a service that is to be performed at a customer's location, factors such as location or proximity can be considered. This can be taken into account, for example, by adjusting CTR to reflect how likely a customer is to buy an item that needs to be picked up based on how far the customer would have to drive to pick up the item. If three offers pass the pricing and availability criteria, for example, the featured offer also could simply be the offer from the merchant closest to the customer, the distances could be ranked, or only offers within a certain distance of the closest merchant will be considered.

Also, customer preference information can be used as a filter or criteria. For example, a customer might have a preference stored that indicates the customer does not want to see featured ads, or that a customer does not wish to purchase items from a specific merchant. A customer also might have a list of favored merchants, whereby the customer wishes to see items from those merchants featured even if other offers feature more favorable terms. A customer also can specify that the customer always wants to see the lowest priced offer, only items in stock, items shipping domestically, etc. Many other such situations and criteria should be apparent from the teachings and suggestions contained herein.

As discussed above, the various embodiments can be implemented in a wide variety of operating environments, which in some cases can include one or more user computers, computing devices, or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems, and other devices capable of communicating via a network.

Most embodiments utilize at least one network that would be familiar to those skilled in the art for supporting communications using any of a variety of commercially-available protocols, such as TCP/IP, OSI, FTP, UPnP, NFS, CIFS, and AppleTalk. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including HTTP servers, FTP servers, CGI servers, data servers, Java servers, and business application servers. The server(s) also may be capable of executing programs or scripts in response requests from user devices, such as by executing one or more Web applications that may be implemented as one or more scripts or programs written in any programming language, such as Java®, C, C# or C++, or any scripting language, such as Perl, Python, or TCL, as well as combinations thereof. The server(s) may also include database servers, including without limitation those commercially available from Oracle®, Microsoft®, Sybase®, and IBM®. In one embodiment a system utilizes Berkeley DB, which is a family of open source, embeddable databases that allows developers to incorporate within their applications a fast, scalable, transactional database engine with industrial grade reliability and availability.

The environment can include a variety of data stores and other memory and storage media as discussed above. These can reside in a variety of locations, such as on a storage medium local to (and/or resident in) one or more of the computers are remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A computer-implemented method of selecting an offer for consumption of an item to display in an electronic marketplace, comprising:

under control of one or more computer systems configured with executable instructions, obtaining a set of offers for an item available for consumption through the electronic marketplace, at least a portion of the set of offers corresponding to different providers, each offer having fixed pricing information including a predetermined offer price for the item;

filtering the set of offers to determine at least one qualified offer that meets at least one merchant qualification criterion with respect to at least one merchant rating;

determining that there is more than one qualified offer for the items;

determining an estimated conversion rate for each qualified offer;

determining a contribution profit for each qualified offer based at least in part on the predetermined offer price for the item;

generating a feature score based at least in part on a combination of the estimated conversion rate and the contribution profit for each qualified offer; and providing for display a page for the item including the qualified offer with an optimal feature score as a featured offer.

2. A method according to claim 1, wherein:

generating the feature score includes determining a product of the estimated conversion rate and a maximum value for the contribution profit for each qualified offer.

3. A method according to claim 2, further comprising:

weighting at least one of the conversion rate and the maximum value when generating the feature score for each qualified offer.

4. A method according to claim 1, further comprising:

where multiple qualified offers receive a feature score, providing for display at least the qualified offer with a next-best score as a secondary offer in the page.

5. A method according to claim 1, wherein:

each qualified offer is provided on behalf of a first party merchant associated with the electronic marketplace or a third party merchant offering items through the electronic marketplace.

6. A method according to claim 5, further comprising:

selecting a qualified offer for display as a featured offer when the qualified offer is provided on behalf of the first party merchant.

7. A method according to claim 1, wherein filtering the set of offers includes utilizing at least one filter based on at least one of minimum or maximum pricing, time of availability, item location, item proximity to the customer, customer history, customer preference information, and minimum merchant rating.

8. A method according to claim 1, further comprising:

selecting at least one additional qualified offer to display on the page.

9. A method according to claim 1, wherein:

determining a contribution profit for each qualified offer includes determining any additional profit that can be obtained by providing an advertisement on the page relating to a merchant providing the qualified offer.

10. A method according to claim 1, wherein:

obtaining a set of offers includes determining offers corresponding to merchants indicated to be qualified to provide featured offers for the item.

11. A method according to claim 1, wherein:

determining an estimated conversion rate for each qualified offer includes determining an estimated conversion rate for a merchant corresponding to the qualified offer based on at least one of a conversion rate for that item, a subset of items offered by the merchant, or all items offered by the merchant.

12. A method according to claim 1, wherein determining said at least one qualified offer among the set of offers comprises determining said at least one merchant rating based at least in part on an associated merchant sales volume.

13. A method according to claim 1, wherein determining said at least one qualified offer among the set of offers comprises determining said at least one merchant rating based at least in part on an associated merchant return volume.

14. A method according to claim 1, wherein determining said at least one qualified offer among the set of offers comprises determining said at least one merchant rating based at least in part on an associated merchant feedback rating.

15. A method according to claim 1, wherein determining said at least one qualified offer among the set of offers comprises determining said at least one merchant rating based at least in part on an associated customer complaint volume.

16. A method according to claim 1, wherein determining said at least one qualified offer among the set of offers comprises determining that said at least one qualified offer meets at least one time-based availability qualification criterion.

17. A method according to claim 1, wherein:

the estimated conversion rate for each qualified offer is a merchant-level conversion rate determined based at least in part on performance of a plurality of items sold by a merchant;

the contribution profit for each qualified offer is an offer-level contribution profit determined based at least in part on the predetermined offer price for the item; and the feature score for each qualified offer is based at least in part on a combination of the merchant-level conversion rate and the offer-level contribution profit.

18. A method according to claim 17, wherein the merchant sells items in a plurality of categories and the merchant-level conversion rate is determined based at least in part on performance of the plurality of items sold by the merchant in a category of the plurality of categories that includes the item.

19. A system for selecting an offer for consumption of an item to display via an electronic marketplace, comprising:

a processor; and a memory device including instructions that, when executed by the processor, cause the processor to, at least:

obtain a set of offers for an item available for consumption through the electronic marketplace, at least a portion of the set of offers corresponding to different providers, each offer having fixed pricing information including a predetermined offer price for the item;

filter the set of offers to determine at least one qualified offer that meets at least one merchant qualification criterion with respect to at least one merchant rating;

determine that there is more than one qualified offer for the item;

determine an estimated conversion rate for each qualified offer;

determine a contribution profit for each qualified offer based at least in part on the predetermined offer price for the item;

generate a feature score based at least in part on a combination of the estimated conversion rate and the contribution profit for each qualified offer; and provide for display a page for the item including the qualified offer with an optimal feature score as a featured offer.

20. A system according to claim 19, wherein the memory device further includes instructions that, when executed by the processor, cause the processor to:

generate the feature score by determining a product of the estimated conversion rate and a maximum value for the contribution profit for each qualified offer.

21. A system according to claim 20, wherein the memory device further includes instructions that, when executed by the processor, cause the processor to:

weight at least one of the conversion rate and the maximum value for the contribution profit when generating the feature score for each qualified offer.

22. A system according to claim 19, wherein the memory device further includes instructions that, when executed by the processor, cause the processor to:

where multiple qualified offers receive a feature score, provide for display at least the qualified offer with a next-best score as a secondary offer in the page.

23. A non-transitory computer readable storage medium including instructions for selecting an offer for consumption in an electronic marketplace, the instructions when executed by a computer system causing the computer system to, at least:

obtain a set of offers for an item available for consumption through the electronic marketplace, at least a portion of the set of offers corresponding to different providers, each offer having fixed pricing information including a predetermined offer price for the item;

filter the set of offers to determine at least one qualified offer that meets at least one merchant qualification criterion with respect to at least one merchant rating; and determine that there is more than one qualified offer for the item;

determine an estimated conversion rate for each qualified offer;

determine a contribution profit for each qualified offer based at least in part on the predetermined offer price for the item;

generate a feature score based at least in part on a combination of the estimated conversion rate and the contribution profit for each qualified offer; and provide for display a page for the item including the qualified offer with an optimal feature score as a featured offer.

24. A computer readable storage medium according to claim 23, wherein:

generating the feature score includes determining a product of the estimated conversion rate and a maximum value for the contribution profit for each qualified offer.

25. A computer readable storage medium according to claim 23, wherein the instructions when executed further cause the computer system to:

utilize at least one filter when filtering the set of offers, the at least one filter being based on at least one of pricing, availability, item location, item proximity to the customer, customer history, customer preference information, and minimum merchant rating.

* * * * *

UNITED STATES PATENT AND TRADEMARK OFFICE

CERTIFICATE OF CORRECTION

PATENT NO. : 8,583,513 B1
APPLICATION NO. : 12/048490
DATED : November 12, 2013
INVENTOR(S) : Kamlesh T. Talreja, Timothy R. Kohn and Jonathan Joseph Bryak It is certified that error appears in the above-identified patent and that said Letters Patent is hereby corrected as shown below:

In the Claims Section,

Claim 1, column 16, line 56, please delete "for the items"

and insert -- for the item --

Signed and Sealed this
Third Day of June, 2014

Michelle K. Lee

Michelle K. Lee
*Deputy Director of the United States Patent and Trademark Office*